US006715425B1

(12) United States Patent
Dore

(10) Patent No.: US 6,715,425 B1
(45) Date of Patent: Apr. 6, 2004

(54) RACE OBSERVATION RAIL SYSTEM

(76) Inventor: David J. Dore, 152 St. John's Way, Longdon (GB), N19 3RL ( * ) Notice: Subject to any disclaimer, the term of this patent is extended or adjusted under 35 U.S.C. 154(b) by 3 days.

(21) Appl. No.: 10/282,316

(22) Filed: Oct. 29, 2002

(51) Int. Cl.[7] ..... A63G 1/00
(52) U.S. Cl. ..... 104/53; 104/60; 463/58
(58) Field of Search ..... 104/53, 60, 61, 104/83, 85, 118; 463/58, 59, 60, 61, 62, 63, 64, 65, 66, 67, 68, 69; 472/13, 128

(56) References Cited

U.S. PATENT DOCUMENTS 583,109 A * 5/1897 Daniels ..... 104/61
1,474,335 A * 11/1923 Lalle et al. ..... 104/60
1,844,141 A * 2/1932 Atwater ..... 104/60
2,387,859 A * 10/1945 Schmidt ..... 238/10 A
3,441,277 A * 4/1969 Winn ..... 463/68
3,961,791 A * 6/1976 Etchegoyhen ..... 463/61
4,031,662 A * 6/1977 Beshany ..... 104/118
5,669,821 A * 9/1997 Prather et al. ..... 472/59
6,066,049 A * 5/2000 Milanian ..... 472/13

* cited by examiner

*Primary Examiner*—S. Joseph Morano
*Assistant Examiner*—Frantz F. Jules

(57) ABSTRACT

A race observation rail system for allowing close-up viewing of a race by the spectators. The race observation rail system includes a race track being disposed upon a ground; and also includes a rail assembly including support members being adapted to be disposed in the ground and also including an endless rail being mounted to the support members and being set up along and adjacent the race track; and further includes a pod assembly including a pod member being movably mounted upon the endless rail and having an assembly of viewing a race being run on the race track; and also includes a drive assembly for moving the pod member upon and along the endless rail.

4 Claims, 5 Drawing Sheets

RACE OBSERVATION RAIL SYSTEM

BACKGROUND OF THE INVENTION

1. Field of the Invention

The present invention relates to race observation rails and more particularly pertains to a new race observation rail system for allowing close-up viewing of a race by the spectators.

2. Description of the Prior Art

The use of race observation rails is known in the prior art. More specifically, race observation rails heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,845,581; U.S. Pat. No. 3,568,605; U.S. Pat. No. 5,325,817; U.S. Pat. No. 4,070,016; U.S. Pat. No. 4,217,727; and U.S. Des. Pat. No. 344,304.

While these devices fulfill their respective, particular objectives and requirements, the aforementioned patents do not disclose a new race observation rail system. The prior art includes monorail systems having cars mounted upon rails.

SUMMARY OF THE INVENTION

The general purpose of the present invention, which will be described subsequently in greater detail, is to provide a new race observation rail system which has many of the advantages of the race observation rails mentioned heretofore and many novel features that result in a new race observation rail system which is not anticipated, rendered obvious, suggested, or even implied by any of the prior art race observation rails, either alone or in any combination thereof. The present invention includes a race track being disposed upon a ground; and also includes a rail assembly including support members being adapted to be disposed in the ground and also including an endless rail being mounted to the support members and being set up along and adjacent the race track; and further includes a pod assembly including a pod member being movably mounted upon the endless rail and having an assembly of viewing a race being run on the race track; and also includes a drive assembly for moving the pod member upon and along the endless rail. None of the prior art describes the combination of elements of the present invention.

There has thus been outlined, rather broadly, the more important features of the race observation rail system in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new race observation rail system which has many of the advantages of the race observation rails mentioned heretofore and many novel features that result in a new race observation rail system which is not anticipated, rendered obvious, suggested, or even implied by any of the prior art race observation rails, either alone or in any combination thereof.

Still another object of the present invention is to provide a new race observation rail system for allowing close-up viewing of a race by the spectators.

Still yet another object of the present invention is to provide a new race observation rail system that is easy and convenient to set up.

Even still another object of the present invention is to provide a new race observation rail system that allows the user to get a feel of the actual race by being almost a part of the race and by being able to see every action of the particular race.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
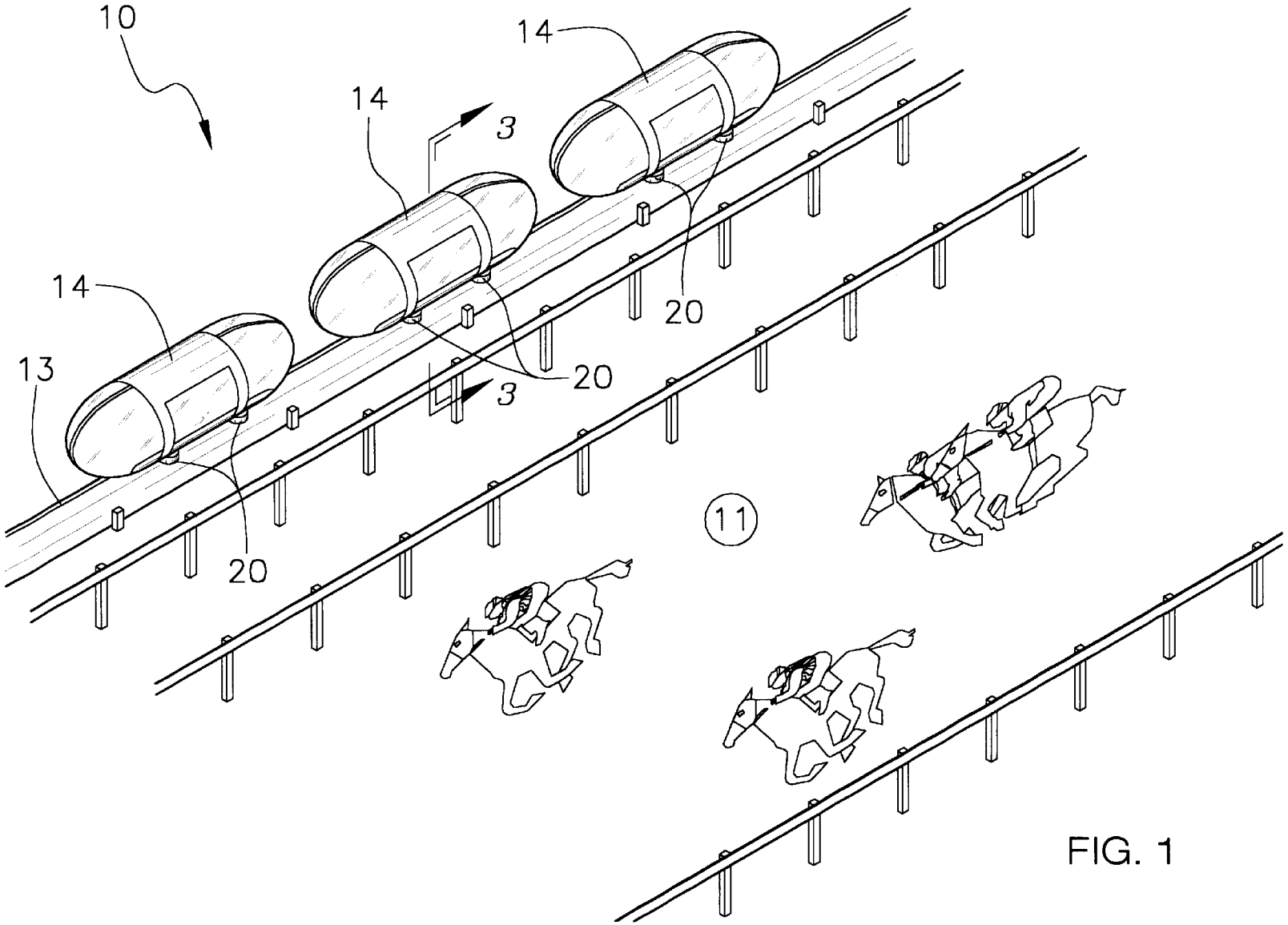
FIG. 1 is a prespective view of a new race observation rail system according to the present invention.
Figure 2:
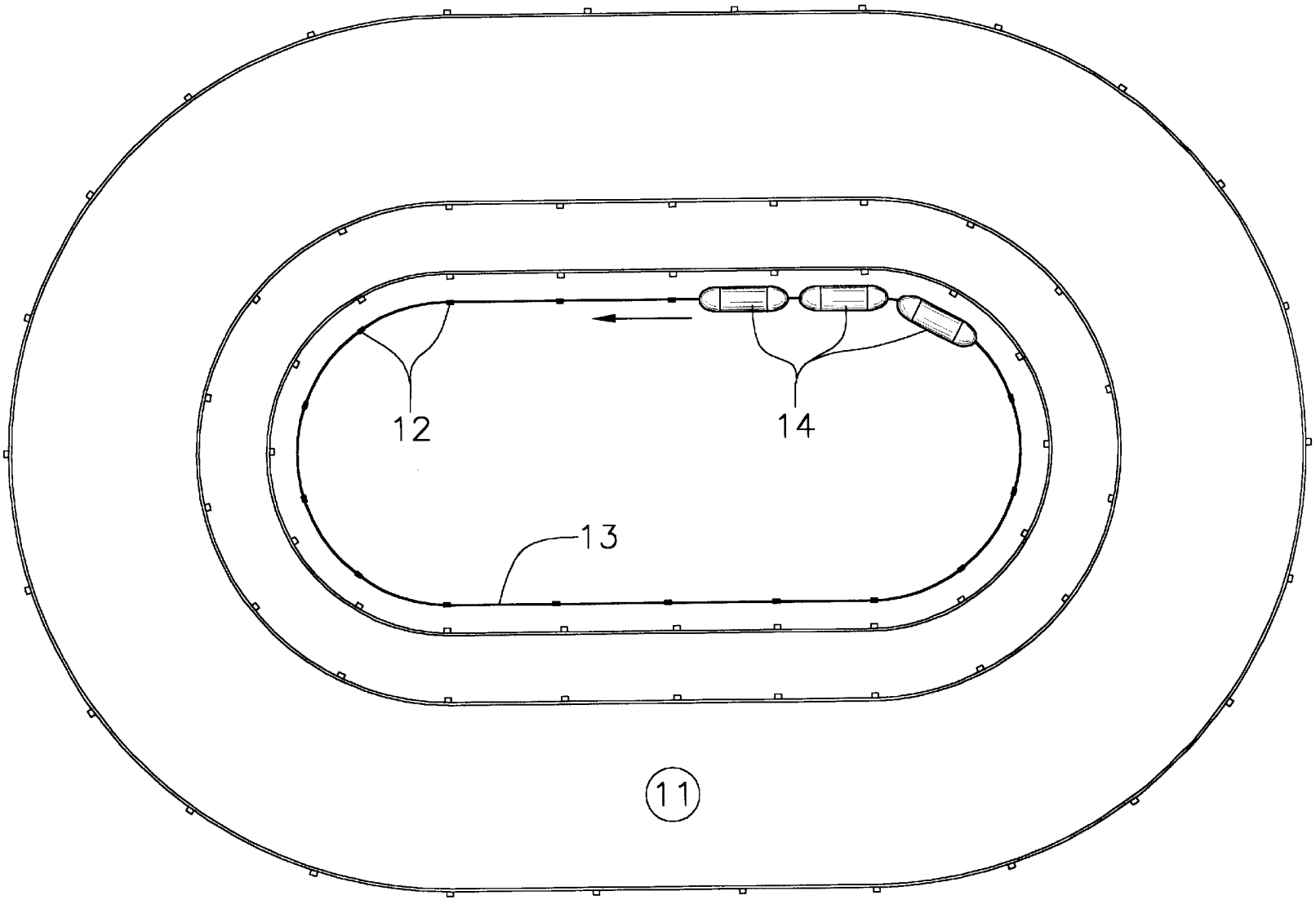
FIG. 2 is a top plan view of the present invention.
Figure 3:
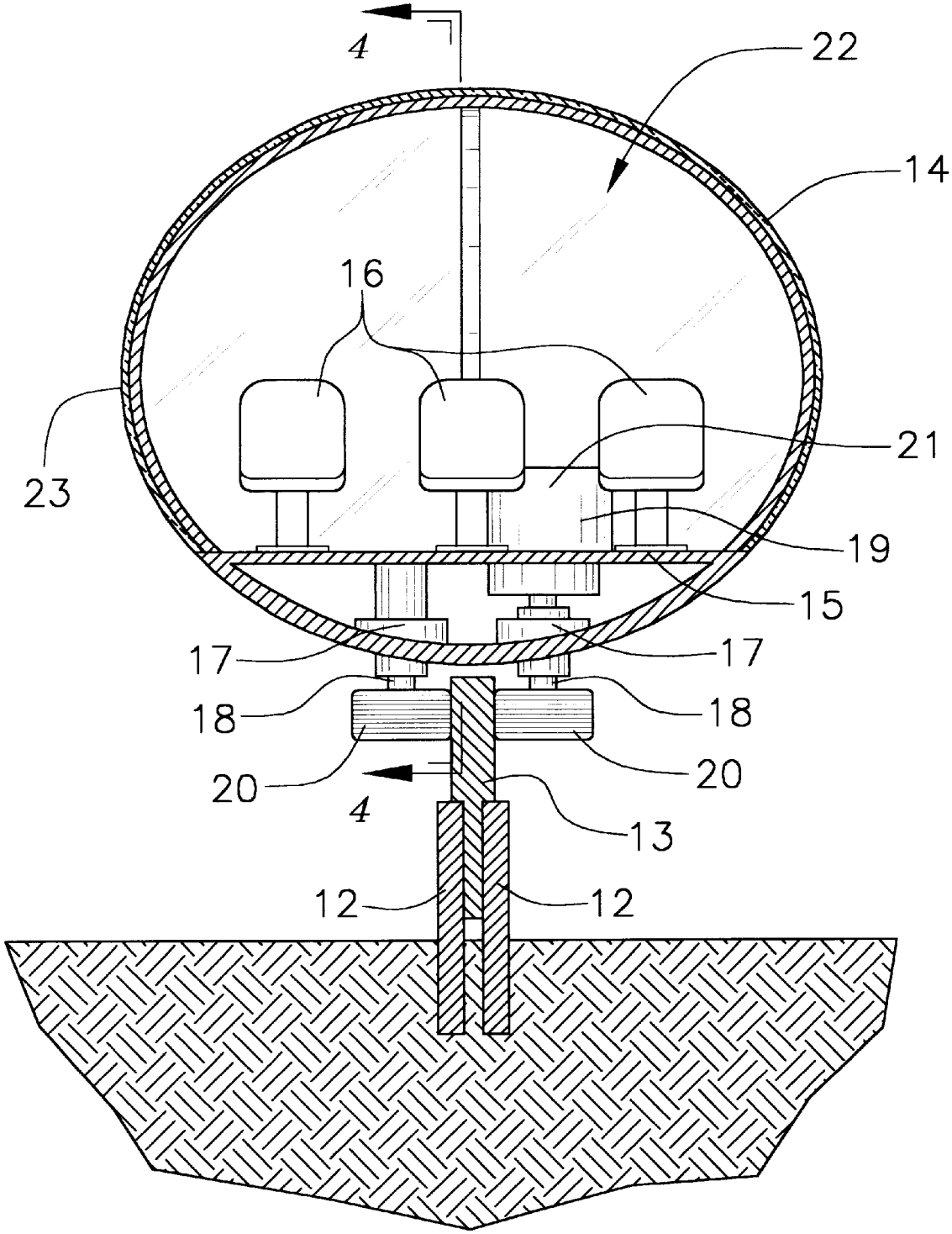
FIG. 3 is a lateral cross-sectional view of one of the pod members of the present invention.
Figure 4:
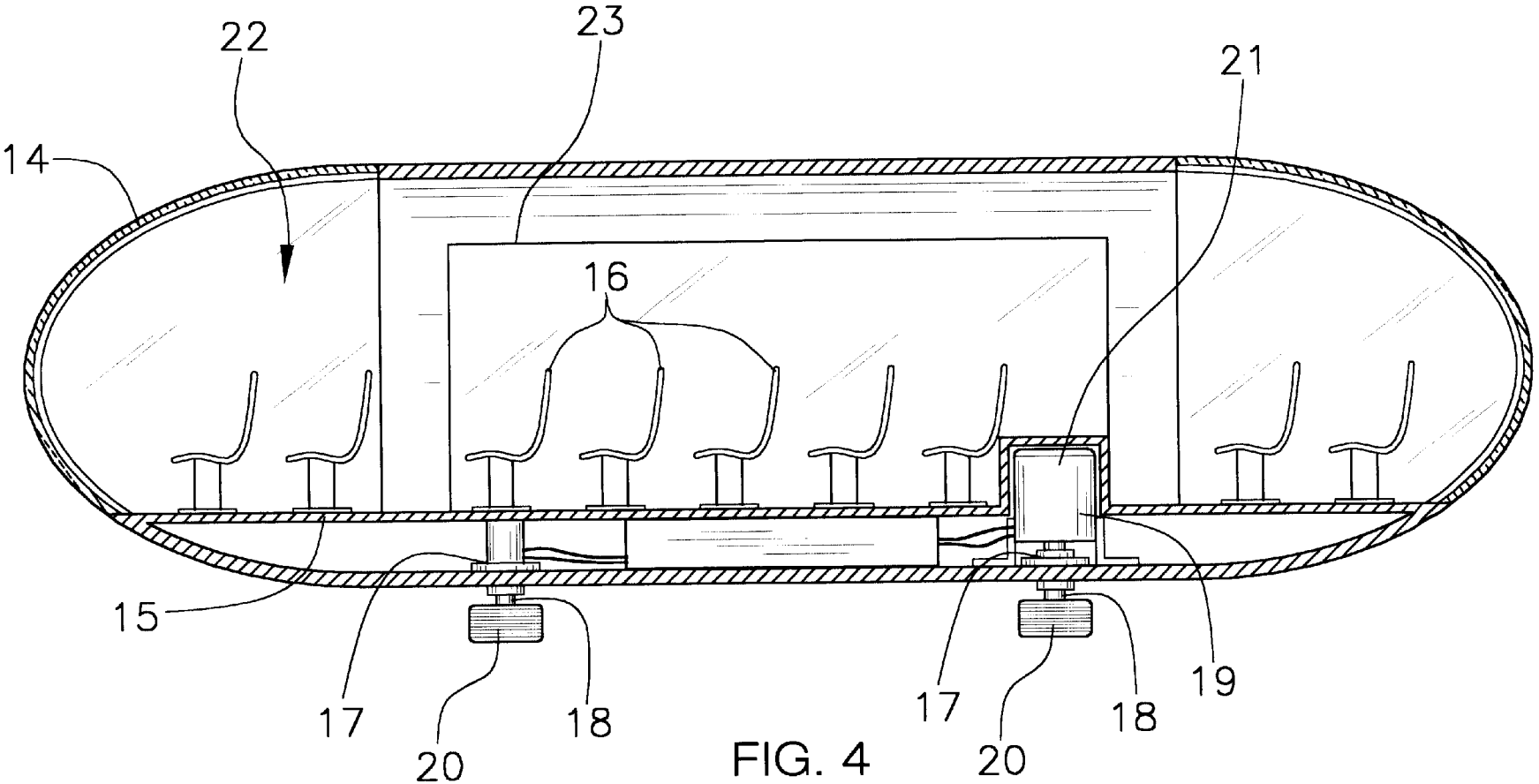
FIG. 4 is a longitudinal cross-sectional view of one of the pod members of the present invention.
Figure 5:
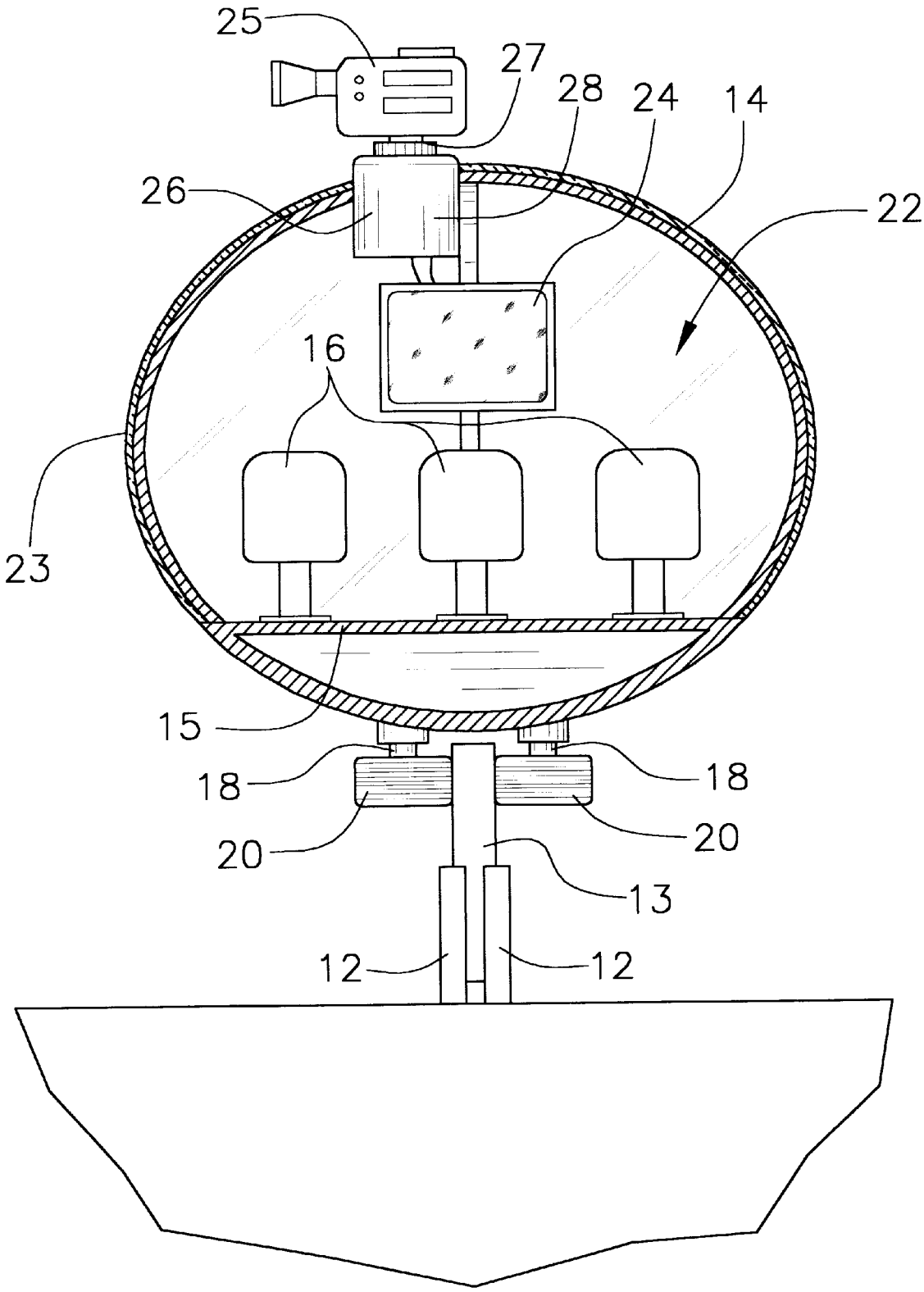
FIG. 5 is another lateral cross-sectional view of one of the pod members of the present invention.

With reference now to the drawings, and in particular to FIGS. 1 through 5 thereof, a new race observation rail system embodying the principles and concepts of the present invention and generally designated by the reference numeral 10 will be described.

As best illustrated in FIGS. 1 through 5, the race observation rail system 10 generally comprises a race track 11 being conventionally disposed upon a ground and upon which horse races, in particular, are held.

A rail assembly includes support members 12 being conventionally disposed in the ground and also including an endless rail 13 being conventionally mounted to the support members 12 and being set up along and adjacent the race track 11.

A pod assembly includes one or more pod members 14 being movably and conventionally mounted upon the endless rail 13 and having a means of viewing a race being run on the race track 11. Each pod member 14 is capsule-shaped with parabolic ends. The pod assembly includes a floor 15 being conventionally disposed in each pod member 14 and upon which seats 16 are securely and conventionally mounted.

A drive assembly for moving the pod member 14 upon and along the endless rail 11 includes bearing members 17 being conventionally disposed in a bottom wall of the pod member 14, and also includes shaft members 18 being journaled through the bearing members 17, and further includes a motor 19 being conventionally attached to the pod member 14 and being conventionally attached to the shaft members 17 for the rotation thereof, and also includes wheels 20 being conventionally mounted to the shaft members 17 and being engaged to the endless rail 11, and further includes a control unit 21 being conventionally disposed in the pod member 14 and being conventionally attached to the motor 19 for the energizing thereof. The wheels 20 includes pairs of the wheels with said wheels 20 in said pairs of wheels being spaced apart with the endless rail 12 being disposed therebetween. The means of viewing a race includes a passenger compartment 22 being disposed in the pod member 14, and also includes the seats 16 being arranged and disposed in the passenger compartment 22 for seating passengers thereupon, and also having windows 23 being conventionally disposed in a side wall thereof for passengers to view the race. The means of viewing a race further includes a TV monitor 24 being securely and conventionally attached in the pod member 14 forward of the seats 16, and also includes a camera unit being conventionally attached to the pod member 14 and having a base 26, a motor 27 being mounted to the base and having a rotatable shaft, and also having a camera 25 being conventionally mounted to the rotatable shaft, and further having camera controls 28 being conventionally mounted to the base 26 for controlling rotation of the camera 25.

In use, the user boards the pod member 14 and sits upon one of the seats 16 and the pod member 14 is energized by the motor 19 and moves along the endless rail 12 when the horse race begins, and also travels adjacent to the horses running on the race track 11 so that the user gets a birds-eye view of the race.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the race observation rail system. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A race observation rail system comprising:

a race track being disposed upon a ground and upon which horses race;

a rail assembly including support members being adapted to be disposed in said ground and also including an endless rail being mounted to said support members and being set up along and adjacent said race track;

a pod assembly including a pod member being movably mounted upon said endless rail and having a means of viewing a race being run on said race track, said pod member being capsule-shaped with parabolic ends, said pod assembly including a floor being disposed in said pod member and upon which seats are securely mounted; and a drive assembly for moving said pod member upon and along said endless rail, said drive assembly including bearing members being disposed in a bottom wall of said pod member, and also including shaft members being journaled through said bearing members, and further including a motor being attached to said pod member and being attached to one of said shaft members for the rotation thereof, and also including wheels being mounted to said shaft members and being engaged to said endless rail, and a control unit being disposed in said pod member and being attached to said motor for the energizing thereof.

2. A race observation rail system as described in claim 1, wherein said wheels includes pairs of said wheels with said wheels of each said pair of wheels being spaced apart with said endless rail being disposed therebetween.

3. A race observation rail system as described in claim 2, wherein said means of viewing a race includes a passenger compartment being disposed in said pod member, and also includes said seats being arranged and disposed in said passenger compartment for seating passengers thereupon, and also having windows being disposed in a side wall thereof for passengers to view the race.

4. A race observation rail system as described in claim 3, wherein said means of viewing a race further includes a TV monitor being securely attached in said pod member forward of said seats, and also includes a camera unit being attached to said pod member and having a base, a motor being mounted to said base and having a rotatable shaft, and also having a camera being mounted to said rotatable shaft, and further having camera controls being mounted to said base for controlling rotation of said camera.

* * * * *